US006123832A

United States Patent [19]

Ho et al.

[11] Patent Number: 6,123,832

[45] Date of Patent: Sep. 26, 2000

[54] FLUID CATALYTIC CRACKING PROCESS FOR CONVERTING HYDROCARBON MIXTURES

[75] Inventors: Teh Chung Ho; Shun Chong Fung, both of Bridgewater, N.J.; Gordon Frederick Stuntz; Robert Charles Welch, both of Baton Rouge, La.; Daniel Paul Leta, Flemington, N.J.

[73] Assignee: Exxon Research and Engineering Co., Florham Park, N.J.

[21] Appl. No.: 09/231,697

[22] Filed: Jan. 14, 1999

Related U.S. Application Data

[63] Continuation-in-part of application No. 09/067,869, Apr. 28, 1998, abandoned.

[51] Int. Cl.[7] ..... C10G 55/06; C10G 11/00

[52] U.S. Cl. ..... 208/113; 208/70; 208/78

[58] Field of Search ..... 208/113, 78, 80, 208/70

[56] References Cited

U.S. PATENT DOCUMENTS

| | | | |
|---|---|---|---|
| 4,624,771 | 11/1986 | Lane et al. | 208/74 |
| 4,871,446 | 10/1989 | Herbst et al. | 208/152 |
| 5,098,554 | 3/1992 | Krishna et al. | 208/113 |
| 5,389,232 | 2/1995 | Adewuyi et al. | 208/120 |
| 5,435,906 | 7/1995 | Johnson et al. | 208/78 |
| 5,506,365 | 4/1996 | Mauleon et al. | 585/329 |

FOREIGN PATENT DOCUMENTS

| | | | |
|---|---|---|---|
| 0101553 | 2/1984 | European Pat. Off. | C10G 11/18 |
| 0369536 | 5/1990 | European Pat. Off. | C10G 11/18 |
| 0323297 | 7/1989 | France | C10G 11/18 |

*Primary Examiner*—Walter D. Griffin
*Assistant Examiner*—Tam M Nguyen
*Attorney, Agent, or Firm*—Estelle C. Bakun

[57] ABSTRACT

The invention relates to Fluid Catalytic Cracking (FCC) for producing liquid fuels and light olefins from liquid hydrocarbon mixtures such as petroleum fractions.

11 Claims, 3 Drawing Sheets

FLUID CATALYTIC CRACKING PROCESS FOR CONVERTING HYDROCARBON MIXTURES

This is a Continuation-In-Part of U.S. Ser. No. 067,869, filed Apr. 28, 1998, now abandoned, and which is based upon Patent Memoranda 96CL-023 and 96CL-010.

FIELD OF THE INVENTION

This invention relates to Fluid Catalytic Cracking (FCC) for producing liquid fuels and light olefins from liquid hydrocarbon mixtures such as petroleum fractions. More specifically, it relates to an improved FCC process, especially for converting hydrocarbon mixtures by taking advantage of a process nonlinearity.

BACKGROUND OF THE INVENTION

FCC has been, and will remain for quite some time, the primary conversion process in oil refining. In a typical present-day FCC process, a liquid feed mixture is atomized through a nozzle to form small droplets at the bottom of a riser. The droplets contact hot regenerated catalyst and are vaporized and cracked to lighter products and coke. The vaporized products rise through the riser. The catalyst is separated out from the hydrocarbon stream through cyclones. Once separated, the catalyst is stripped in a steam stripper of adsorbed hydrocarbons and then fed to a regenerator where coke is burned off. The products are sent to a fractionator for fractionation into several products. The catalyst, once regenerated, is then fed back into the riser. The riser-regenerator assembly is heat balanced in that heat generated by the coke burn is used for feed vaporization and cracking. The most common FCC feeds by far are gas oils or vacuum gas oils (VGO) which are hydrocarbon mixtures boiling above about 650° F. When refiners need to convert heavy, or highly contaminated oils such as resids, they usually blend a small amount of such heavy oils with the gas oil feeds. Due to a dwindling supply of high-quality crudes, the trend in the petroleum industry is that FCC will have to convert more and more heavy, dirty feeds. Such feeds contain a high level of contaminants such as nitrogen, sulfur, metals, polynuclear aromatics, and Conradson Carbon Residue (CCR, a measure of asphaltene content). Hereafter, the term heavy component is used to include such highly contaminated hydrocarbons as resids, deasphalted oils, lube extracts, tar sands, coal liquids, and the like. Such heavy components are added to other feeds containing less heavy components to obtain an FCC feed. These heavy components will become a significant portion of FCC feeds in years to come.

The technical problems encountered with FCC feeds containing heavy components have been reviewed by Otterstedt et al., (Otterstedt, J. E., Gevert, S. B., Jaras, S. G., and Menon, P. G., Applied Catalysis, 22, 159, 1986). Chief among them are high coke and gas yields, catalyst deactivation, and $SO_x$ in flue gas. The coke forming tendency of such heavy component-containing feeds has traditionally been gauged by their CCR content. VGO feeds typically contain less than 0.5 wt % CCR, whereas atmospheric and vacuum resids typically contain 1 to 15 wt % and 4 to 25 wt % CCR, respectively. Since cracking of such heavy components can produce coke levels far higher than that required or tolerable by existing FCC units, the maximum permissible level of the heavy component in the FCC feed is often limited by the unit's coke burning capacity. Many FCC units today are capable of cracking only 5–15 wt % resid, or heavy component, in the feed. Due to feed cost considerations, there is a strong need for economical methods that can expand the FCC's operating envelope to enable increased amounts of the heavy component to be utilized in the feeds processed in existing FCC units.

A significant fraction of the cracking and catalyst coking in FCC takes place at the riser bottom where the feed is injected through multiple nozzles. Today's FCC feed injectors typically consist of rings around the riser wall with 6 to 10 nozzles. These nozzles can be at the same elevation or in two rows one above the other. When the FCC feed contains a heavy component such as resid, the standard practice has been to premix the heavy component with gas oil and inject the resulting mixture through all of the nozzles. A major effort in FCC has been directed toward the improvement of the spray pattern to minimize the variation in the catalyst-to-oil ratio over the riser cross-section. For this reason, feed nozzles that produce a flat fan of liquid are gaining wide acceptance these days (see R. J. Glendining, T. Y. Chan, and C. D. Fochtman, NPRA Paper AM-96-25, San Antonio, Tex., Mar. 17, 1996).

Much effort has also been expended on the improvement of cracking selectivity through feed separation. For instance, U.S. Pat. No. 3,424,672 increased gasoline yield by cracking topped crude and low octane light reformed gasoline in separate risers. U.S. Pat. No. 3,617,496 improved gasoline selectivity by fractionating the FCC feed into a low and high molecular weight fractions and then cracking said fractions in separate riser reactors. In U.S. Pat. No. 3,448,037, a virgin gas oil and a cracked cycle gas oil are individually cracked through separate reaction zones to recover higher gasoline products. U.S. Pat. No. 3,993,556 cracked heavy and light gas oils in separate risers to improve yields of high octane naphtha. To recover high volatility gasoline, high octane blending stock, light olefins for alkylation, U.S. Pat. No. 3,928,172 proposed to crack a gas oil feed and heavy naphtha and/or virgin naphtha fraction in separate cracking zones. U.S. Pat. No. 3,801,493 cracked virgin gas oil, topped crude and the like, and slack wax in separate risers to recover a light cycle gas oil fraction for furnace oil use and a high octane naphtha fraction suitable for use in motor fuel, respectively. U.S. Pat. No. 5,009,769 described cracking naphtha in a first riser and cracking gas oils and residual oils in a second riser. To improve conversion to gasoline and olefins, U.S. Pat. No. 5,565,176 disclosed separate cracking of a paraffin rich fraction and a CCR-rich fraction.

The prior art work was primarily driven by the market demand to produce high octane gasoline. What is needed in the art is a method which allows for increased use of alternative feeds containing, for instance, heavy components and stretches the operating limits of existing FCC units with yield improvements.

SUMMARY OF THE INVENTION

Applicants have found a nonlinear phenomenon in FCC that leads to an improved FCC process and feed injection method. Specifically, applicants have discovered that the liquid yield does not degrade linearly, nor does the coke yield increase linearly, as the amount of heavy component (e.g., resid, deasphalted oils, lube extracts, tar sands, coal liquids, etc.) in the FCC feed increases. Physically, this means that the damaging marginal effect of feed contaminants on the FCC catalyst becomes increasingly weaker with increasing amounts of heavy components. Thus, the present invention provides an improved FCC process and feed injection method for cracking FCC feeds containing heavy components. One embodiment of the invention is to use at least one nozzle in the unit for injecting a first feed and use the remaining nozzles for injecting a second feed of different quality. Another embodiment is to use two separate risers to convert the two feeds individually. Still another embodiment is to partition the riser into two zones for separate cracking of said feeds at least in a portion of the riser. Compared to prior art methods, the present invention gives a higher overall liquid yield and lower coke selectivity. As an example, the benefit when using at least one feed having Conradson Carbon Residue stems from the fact that the lower CCR feed increases the conversion to a much greater extent than the conversion loss due to the higher CCR containing feed.

Thus, the present invention is directed to a Fluid Catalytic Cracking process conducted in a fluid catalytic cracking unit (FCCU) comprising one or more risers, each of said risers having a plurality of injection nozzles therein and at least one reaction zone therein comprising the steps of spatially nonuniformly injecting a plurality of feeds wherein said plurality of feeds comprises at least one feed (α) and at least another feed (β), wherein said feeds (α) and (β): (a) differ in Conradson Carbon Residue by at least about 2 wt % points or (b) differ in hydrogen content by at least about 0.2 wt %; or (c) differ in API gravities by at least about 2 points; or (d) differ in nitrogen content by at least about 50 ppm; or (e) differ in carbon-to-hydrogen ratio by at least about 0.3; or (f) differ in mean boiling point by at least about 200° F.; and wherein said spatially nonuniform injection is accomplished by (i) simultaneously injecting into a single reaction zone of a single riser said feed (α) from at least one injection nozzle of said riser and said feed (β) from the remaining nozzles of said riser;

(ii) simultaneously injecting said feed (α) into at least one of said reaction zones of said riser of said FCCU and said feed (β) into another of said reaction zones of said riser of said FCCU; or (iii) simultaneously injecting said feed (α) into at least one riser of said FCCU and said feed (β) into a second riser of said FCCU.

Wherein when said spatially nonuniform injection is accomplished by (iii), said feeds are substantially non-paraffinic feeds.

Such operation can result in a higher overall conversion and a lower coke selectivity. The benefit can translate into a higher heavy component-containing feed cracking capacity at constant liquid yield.

The invention is likewise directed to a method for selecting two feeds α and β for use in a Fluid Catalytic Cracking process in a fluid catalytic cracking unit (FCCU) to obtain a predetermined increase in liquid yield and a predetermined decrease in coke make wherein said process comprises nonuniformly injecting said feeds α and β, said spatially nonuniform injection being accomplished by (i) simultaneously injecting into a single reaction zone of a single riser said feed (α) from at least one injection nozzle of said riser and said feed (β) from the remaining nozzles of said riser;

(ii) simultaneously injecting said feed (α) into at least one of said reaction zones of said riser of said FCCU and said feed (β) into another of said reaction zones of said riser of said FCCU; or (iii) simultaneously injecting said feed (α) into at least one riser of said FCCU and said feed (β) into a second riser of said FCCU.

wherein said selection is accomplished by generating a plot of conversion and a plot of coke make versus a feed quality index and selecting from the plots two feeds which exhibit an increase in liquid yield and a decrease in coke make equal to said predetermined increase and decrease as shown by D minus F and G minus E on FIGS. 1*a* and 1*b*, respectively, and wherein said feeds (α) and (β): (a) differ in Conradson Carbon Residue by at least about 2 wt % points or (b) differ in hydrogen content by at least about 0.2 wt %; or (c) differ in API gravities by at least about 2 points; or (d) differ in nitrogen content by at least about 50 ppm; or (e) differ in carbon-to-hydrogen ratio by at least about 0.3; or (f) differ in mean boiling point by at least about 200° F.

The invention is likewise directed to a Fluid Catalytic Cracking process conducted in a fluid catalytic cracking unit (FCCU) comprising one or more risers, each of said risers having a plurality of injection nozzles therein and at least one reaction zone therein comprising the steps of spatially nonuniformly injecting a plurality of feeds wherein said plurality of feeds comprises at least one feed (α) and at least another feed (β), wherein said feeds (α) and (β): (a) differ in Conradson Carbon Residue by at least about 2 wt % points or (b) differ in hydrogen content by at least about 0.2 wt %; or (c) differ in API gravities by at least about 2 points; or (d) differ in nitrogen content by at least about 50 ppm; or (e) differ in carbon-to-hydrogen ratio by at least about 0.3; or (f) differ in mean boiling point by at least about 200° F.; and wherein said spatially nonuniform injection is accomplished by (i) simultaneously injecting into a single reaction zone of a single riser said feed (α) from at least one injection nozzle of said riser and said feed (β) from the remaining nozzles of said riser;

(ii) simultaneously injecting said feed (α) into at least one of said reaction zones of said riser of said FCCU and said feed (β) into another of said reaction zones of said riser of said FCCU; or (iii) simultaneously injecting said feed (α) into at least one riser of said FCCU and said feed (β) into a second riser of said FCCU.

wherein said feeds (α) and (β) are selected by generating a plot of conversion and a plot of coke make versus a feed quality index and selecting from the plots two feeds which exhibit an increase in liquid yield and a decrease in coke make equal to said predetermined increase and decrease as shown by D minus F and G minus E on FIGS. 1*a* and 1*b*, respectively.

As used herein, said predetermined increase in liquid yield and predetermined decrease in coke make, are an increase or decrease over what would be achieved if the two feeds were mixed prior to injection into the riser of said FCC unit.

DETAILED DESCRIPTION OF THE INVENTION

Figure 1:
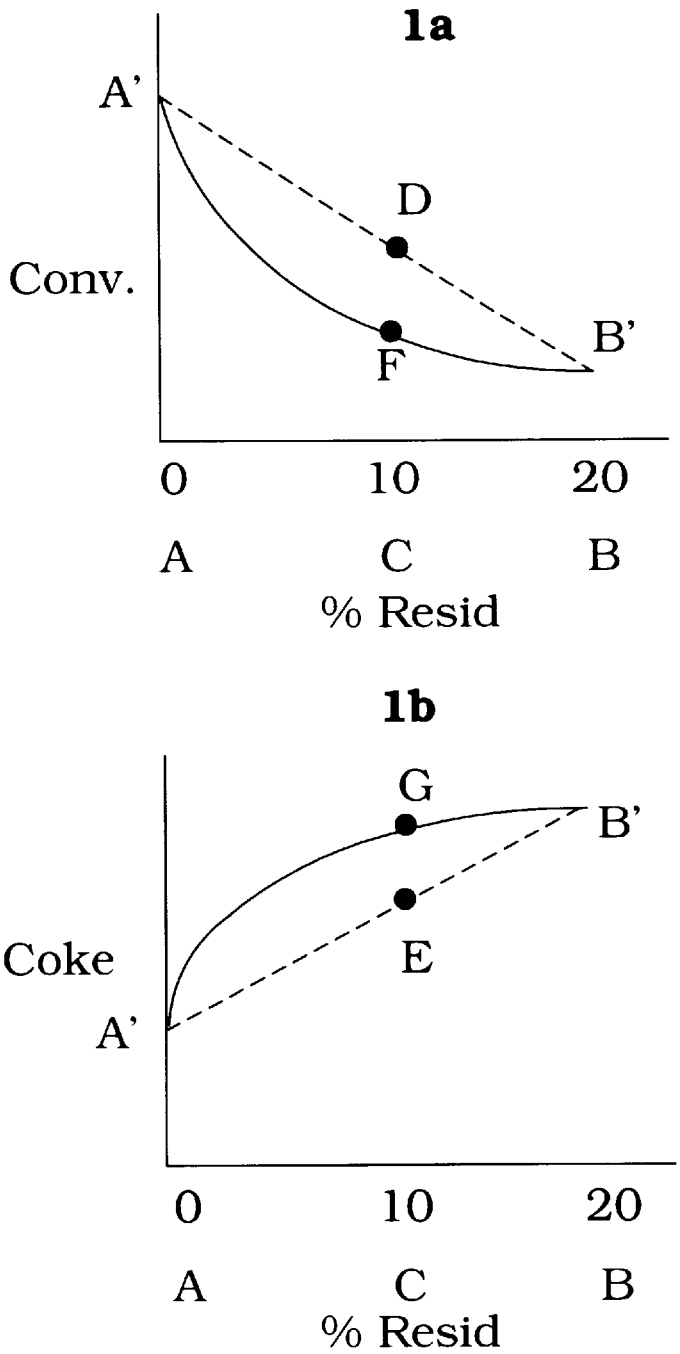
FIG. 1*a*: Conversion as a function of wt % resid in total feed.
FIG. 1*b*: Coke yield as a function of wt % resid in total feed.

The invention is more easily understood from the Figures that can be readily obtained through routinely designed laboratory and/or pilot plant experimentation. FIG. 1 depicts qualitatively the nonlinear dependencies of conversion and coke yield on the concentration of the resid in the feed. The curve for conversion is convex, whereas that for coke yield is concave. For instance, if an FCC unit's coke burning capacity is such that the maximum permissible concentration of the resid is 10 wt %, it is common for the refiners to charge the unit with a feed containing 10 wt % resid in VGO, point C in FIG. 1*a*. The instant invention uses an entirely different approach. Rather than striving for a uniform oil composition over the riser cross section, the invention calls for a spatially nonuniform injection scheme. One embodiment of the present invention is to use a number of the nozzles of the FCC unit for injecting a heavy component-rich feed and the remaining nozzles for injecting a heavy component-lean feed. The rich feed is that having the higher Conradson Carbon number. For example, consider a hypothetical FCC riser having ten nozzles. One may inject straight VGO through six adjacent nozzles, while injecting a 25% resid-in-VGO mixture through the remaining adjacent four nozzles. This gives an overall resid concentration of 10 wt % when all nozzles have the same flow rate. However, in other possible scenarios, it is not necessary for all nozzles to have the same flow rate. Given the finite rate of mixing, these two streams of different compositions will remain locally segregated in a region downstream of the injection zone. Within said region, the system behaves as if there were two risers. Since the bulk of cracking and catalyst coking takes place in the vicinity of the feed injection zone, the conversions and coke yields attained in said region due to cracking of the two streams are significant and can be represented by points A' and B' in FIGS. 1*a* and 1*b*. The blend of the two products are shown as points D and E, which represent the overall conversion and coke make, respectively. Compared to points F and G, one sees that the segregated feed injection gives a higher overall conversion and a lower coke yield. The credits derive from the fact that the loss in conversion due to the heavy component-rich feed is more than compensated by the conversion gain due to the heavy component-lean feed. Put differently, this segregated feed injection protects the bulk of the catalyst by sacrificing a small fraction of the catalyst. The net effect is an increase in conversion and a decrease in coke selectivity.

Figure 3:
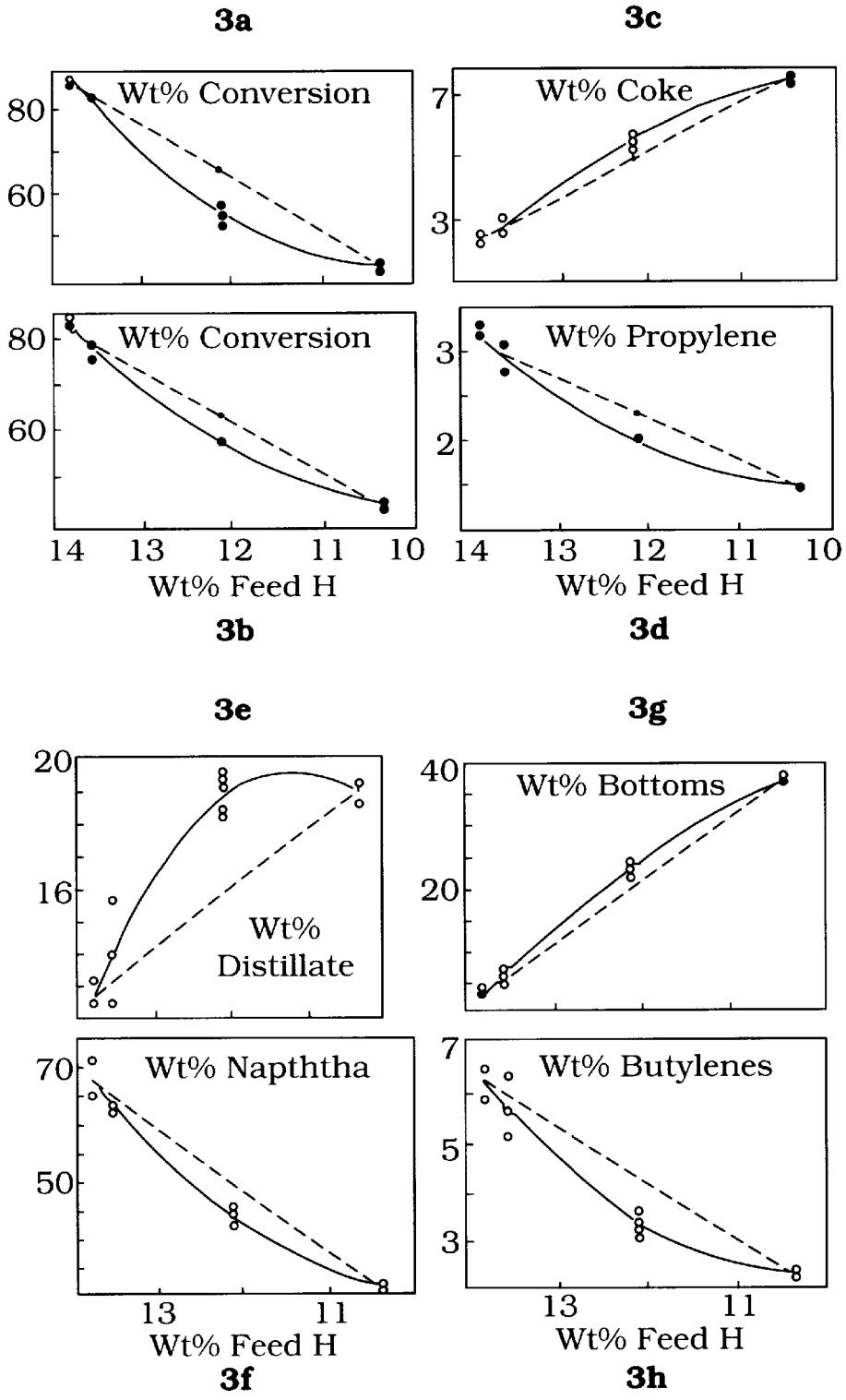
FIG. 3*a*: Conversion to <430° F. products vs. wt % feed hydrogen; 496° C., 6.5 C/O; catalyst A.
FIG. 3*b*: Conversion to <430° F. products vs. wt % feed hydrogen; 496° C., 6.5 C/O; catalyst B.
FIG. 3*c*: Coke yield vs. wt % feed hydrogen; 496° C., 6.5 C/O; catalyst C.
FIG. 3*d*: Propylene yield vs. wt % feed hydrogen; 496° C., 6.5 C/O; catalyst B.
FIG. 3*e*: Distillate yield vs. wt % feed hydrogen; 496° C., 6.5 C/O; catalyst C.
FIG. 3*f*: Naphtha yield vs. wt % feed hydrogen; 496° C., 6.5 C/O; catalyst C.
FIG. 3*g*: Bottoms yield vs. wt % feed hydrogen; 496° C., 6.5 C/O; catalyst C.
FIG. 3*h*: Butylene yield vs. wt % feed hydrogen; 496° C., 6.5 C/O; catalyst C.

Those skilled in the art would know, with reference to the instant invention, how to select the feeds utilizable in the instant invention. Essentially, the feeds are selected from the nonlinear curves of conversion and coke make versus a feed quality index such as wt % resid as shown in FIGS. 1*a* and 1*b*, or wt % feed hydrogen as shown in FIG. 3*b*. As stated earlier, such plots can be obtained a priori in small scale routine experiments. Knowing the FCC unit's resid capacity then helps the skilled artisan to select two feeds (α) and (β) for utilization in the instant invention. For example, if one predetermined that a 3% increase in liquid yield was desired, any two feeds which give the 3% increase [see e.g. (D minus F) on FIG. 1*a*, (D minus F) being the predetermined increase desired] would be selected. Preferably, the increase in liquid yield will be at least about 0.5 wt % on feed, and the decrease in coke make will be at least about 0.2 wt % on feed. The wt % decrease in coke yield would be represented by G minus E on FIG. 1*b*. By selecting two such feeds, the blend of the liquid products from separately cracking the two feeds (D) is higher than that which could be achieved if the two feeds were first mixed and then cracked (F). Note that any feed quality index can be used to generate the plots, e.g. % resid, hydrogen content, API gravity, nitrogen content, C/H ratio, and boiling point. Typically, at least three feeds will be used to generate the plots. For the injection scheme utilizing two separate risers, preferably the feeds will be substantially non-paraffinic. Additionally, substantially non-paraffinic feeds may be used in any of the injection schemes (i) to (iii). As used herein, substantially non-paraffinic means feeds having a Watson K factor of less than 12.2. Most preferably, injection schemes (i) and (ii), which utilize a single riser, will be used.

The versatility of feeds which can be chosen is readily apparent from the above discussion.

For instance, again referring to the above hypothetical case, one may inject straight VGO through seven nozzles, while injecting a 20% resid-in-VGO mixture through the remaining three nozzles. The feed injection rate for the two sets of nozzles are adjusted to give a desired overall resid concentration, e.g., 10 wt %. As a result, the local catalyst-to-oil ratio for the two streams will be different, allowing cracking of each stream to be individually optimized.

Preferably, the nozzles will be chosen such that feed (α) will be injected via adjacent nozzles and feed (β) will be injected via adjacent nozzles. Indeed, the greater the segregation between the feeds (α) and (β), the more effective the process.

The two feed streams can be injected into two reaction zones in the riser achieved by partitioning at least the bottom of the riser.

If the FCC unit in question has two risers, then in accordance with the present invention separate risers can be used for cracking the separate feeds (α) and (β).

The instant process utilizes FCC conditions and catalysts known to those skilled in the art.

From the foregoing discussion, applicants believe that the benefits of the instant invention originate from the convex and concave behaviors illustrated in FIGS. 1*a* and 1*b*. Accordingly, the following illustrative, nonlimiting examples were obtained in experiments aimed at establishing the convex and concave responses to changes in feed heavy component level for various feedstocks, catalysts, and cracking conditions. It should be noted that while FIG. 1 uses the wt % resid-in-feed as the measure of the heavy feed component level, other measures can also be used, for instance, CCR, hydrogen, nitrogen, polars plus multiring aromatics, to name a few.

Although the foregoing is discussed in the context of heavy feed cracking, those skilled in the art would also immediately see that the instant invention can be applied to any feed pair whenever the feed properties are sufficiently different. For instance, for maximum olefin production, the feed pair may comprise a naphtha-rich stock and naphtha-lean stock. Nonlimiting examples of feed properties yardsticks for feeds that have a CCR difference of less than 2 wt % or do not contain CCR, including heavy component-containing feeds having no CCR, are hydrogen content (differing by at least about 0.2 wt %), carbon-to-hydrogen ratio (differing by at least about 0.3), API gravity (differing by at least about 2 points), nitrogen content (differing by at least about 50 ppm), mean boiling point (differing by at least about 200° F.), etc. In a case where only one of the feeds utilized has CCR, the criterion of the instant invention is satisfied if that feed has a CCR content of about 2 wt % points or higher than the other feed which has no CCR or any of the other criteria are met. For cases where at least one of the feeds has CCR, the feeds will preferably differ in API gravities by at least about 3 points. Preferably, only two feeds will be utilized.

In all of the examples given below, the desired non-linear behaviors were observed.

EXAMPLE 1

For this series of experiments a pure VGO and two feed blends comprising a VGO and a vacuum resid (VR) were prepared, one containing 16 wt % resid, the other 32 wt %. Table 1 lists the properties of the feed blends in terms of their CCR (wt %) and indigenous nitrogen (wppm) levels. An equilibrium catalyst impregnated with 3500 ppm Ni was used.

TABLE 1

PROPERTIES OF FEED BLENDS

| VR/VGO, wt %/wt % | CCR | N,ppm |
|---|---|---|
| 0/100 | 0.26 | 1181 |
| 16/84 | 2 | 1524 |
| 32/68 | 4.2 | 1852 |

The cracking experiments were conducted in an FCC pilot unit at 515° C. and a catalyst-to-oil (C/O) ratio of 8. During the run, the catalyst is metered from a regenerated catalyst hopper into a riser using a screw feeder. The hot catalyst contacts incoming oil and gaseous nitrogen and is carried up the riser where the oil is cracked. At the end of the riser, the spent catalyst and reactor products enter a separation zone. Here the gases continue overhead to a product recovery system and the catalyst drops down a stripper and into a spent catalyst hopper. The gaseous products are cooled to produce a $C_5^+$ liquid product and a $C_5^-$ gas product.

Since cracking follows second-order kinetics, a measure of the extent of cracking is the so-called kinetic conversion $\zeta$. Denoting $X_{430}$ as the weight percent conversion to the <430° F. product on a coke-free basis, then $\zeta_{430}=X_{430}/(100-X_{430})$. The coke selectivity S is calculated by $S=Y/\zeta_{430}$ where Y is the weight percent coke yield on feed. Let the percent conversions of the straight VGO and 32% VR-in-VGO feeds be $X_1$ and $X_2$, respectively. Their average kinetic conversion is then $\bar{\zeta}=(X_1+X_2)/2/[100-(X_1+X_2)/2]$, and the corresponding average coke selectivity is $\bar{S}=(Y_1+Y_2)/2/\zeta$.

Figure 2:
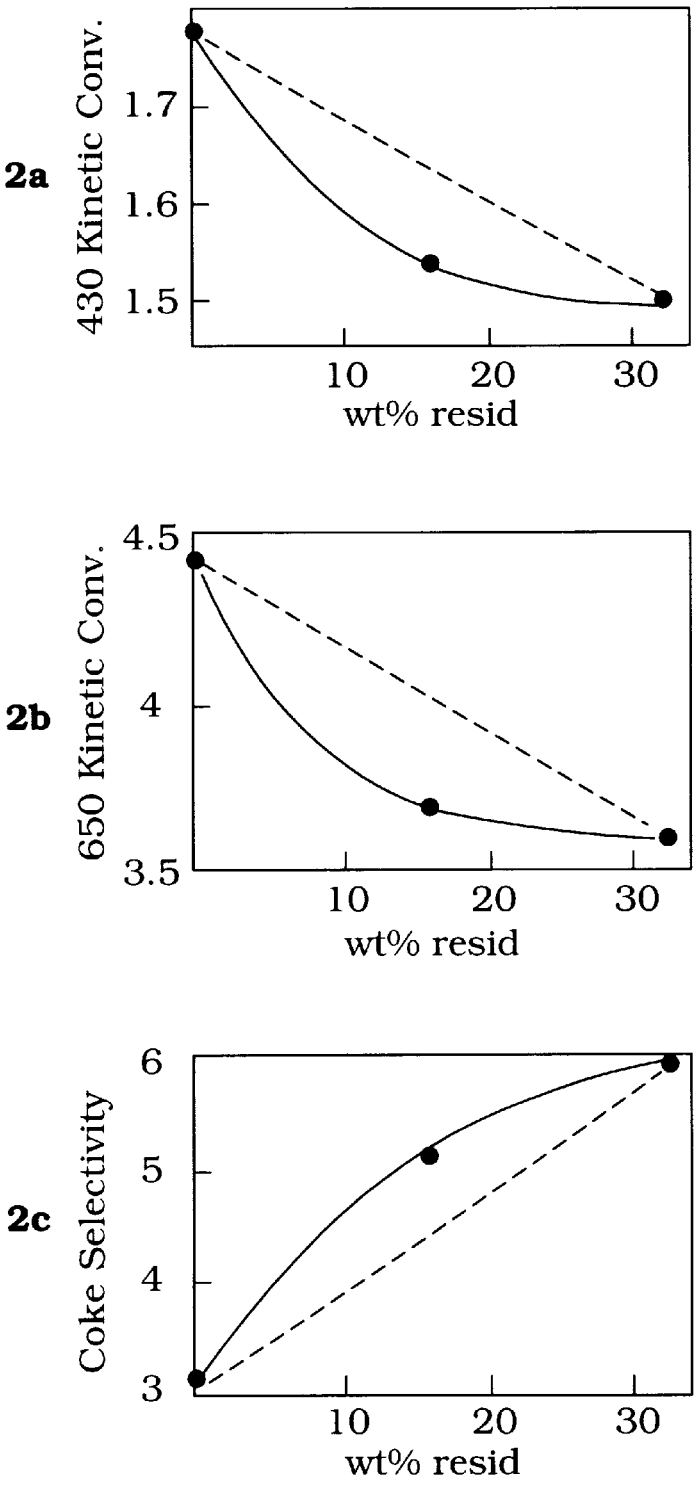
FIG. 2*a*: Coke-free kinetic conversion to <430° F. products vs. wt % resid in feed; 515° C., 8 C/O.
FIG. 2*b*: Coke-free kinetic conversion to <650° F. products vs. wt % resid in feed; 515° C., 8 C/O.
FIG. 2*c*: Coke selectivity vs. wt % resid in feed; 515° C., 8 C/O.

FIGS. 2*a* and 2*b* show, respectively, the coke-free kinetic conversions to <430° F. and <650° F. products as functions of the resid content of the total feed. FIG. 2*c* depicts a similar plot for coke yield. From these plots one can determine the average kinetic conversion and coke selectivity. It follows from FIGS. 2*a* to 2*c* that $\bar{\zeta}$ (for conversions to <430° F. and <650° F. products) are higher than those obtained from the 16% VR-in-VGO feed, while $\bar{S}$ is lower. Each data point is the average of two or three runs. Specifically, the 430 and 650 coke-free kinetic conversions were improved by 5.3% and 7.5%, respectively. That is, in the case of 430 coke-free kinetic conversion, the ratio of $\bar{\zeta}$ to $\zeta$ (for the 16% VR-in-VGO feed) is 1.053. And the coke selectivity is lowered by 12.2%.

EXAMPLE 2

The above experiment was repeated at a C/O of 5. It was observed that the 430 and 650 kinetic conversions increased by 10.2% and 11.7%, respectively. Moreover, the coke selectivity is lowered by 9.3%.

EXAMPLE 3

The experiment described in Example 2 was repeated at 560° C. and a C/O of 5. In this case, the 430 and 650 kinetic conversions were improved by 3.7% and 4.9%, respectively. And the coke selectivity is lowered by 21.5%.

EXAPMLE 4

In this case, the catalyst was the same as in Example 1 except that it was not impregnated with Ni. Cracking conditions are 5 C/O and 515° C. The 430 and 650 kinetic conversions were improved by 8.9% and 10.7%, respectively, with the coke selectivity being decreased by 4.4%. The propylene yield was improved by 6.5%.

EXAMPLE 5

The feed components used in this example are a hydrotreated VGO (HTGO) and a butane-deasphalted resid (DAO). Table 2 lists the compositions and properties of the feed blends.

TABLE 2

PROPERTIES OF FEED BLENDS

| DAO/HTGO, wt %/wt % | CCR | N,ppm |
|---|---|---|
| 0/100 | 0.17 | 541 |
| 20/80 | 1.6 | 1030 |
| 40/60 | 3.0 | 1519 |

The cracking experiments were run at 530° C. and 8 C/O over an equilibrium catalyst different from that used in Example 4. The 430 and 650 kinetic conversions were increased by 4.9% and 10.8%, respectively. The coke selectivity is decreased by 7.4%.

EXAMPLE 6

A vacuum gas oil wa s separated into different fractions having varying hydrogen contents via solvent extraction. These resulting fractions were each cracked at 496° C., 6.5 C/O, and 80 g/m oil rate over several commercial catalysts, designated as catalysts A, B, and C. Table 3 lists the properties of these catalysts. The hydrogen content of the feed was used as the feed quality measure. The data shown in FIGS. 3*a* to 3*h* were obtained for feeds whose hydrogen contents are 10.4, 12.1, 13.6, and 13.8 wt %. The results shown in the Figures clearly show the desired nonlinear effects.

TABLE 3

| CATALYST PROPERTIES | | |
|---|---|---|
| CATALYST | SURFACE AREA, $m^2/g$ | UNIT CELL, Å |
| A | 154 | 24.24 |
| B | 84 | 24.34 |
| C | 80 | 24.38 |

What is claimed is:

1. A method for selecting two feeds α and β for use in a Fluid Catalytic Cracking process in a fluid catalytic cracking unit (FCCU) to obtain a predetermined increase in liquid yield and a predetermined decrease in coke make wherein said process comprises nonuniformly injecting said feeds α and β, said spatially nonuniform injection being accomplished by (i) simultaneously injecting into a single reaction zone of a single riser said feed (α) from at least one injection nozzle of said riser and said feed (β) from the remaining nozzles of said riser;

(ii) simultaneously injecting said feed (α) into at least one of said reaction zones of said riser of said FCCU and said feed (β) into another of said reaction zones of said riser of said FCCU; or (iii) simultaneously injecting said feed (α) into at least one riser of said FCCU and said feed (β) into a second riser of said FCCU, wherein said selection is accomplished by generating a plot of conversion and a plot of coke make versus a feed quality index and selecting from the plots two feeds which exhibit an increase in liquid yield and a decrease in coke make equal to said predetermined increase and decrease as shown by D minus F and G minus E on FIGS. 1*a* and 1*b*, respectively, and wherein said feeds (α) and (β): (a) differ in Conradson Carbon Residue by at least about 2 wt % points or (b) differ in hydrogen content by at least about 0.2 wt %; or (c) differ in API gravities by at least about 2 points; or (d) differ in nitrogen content by at least about 50 ppm; or (e) differ in carbon-to-hydrogen ratio by at least about 0.3; or (f) differ in mean boiling point by at least about 200° F.

2. A Fluid Catalytic Cracking process conducted in a fluid catalytic cracking unit (FCCU) comprising one or more risers, each of said risers having a plurality of injection nozzles therein and at least one reaction zone therein comprising the steps of spatially nonuniformly injecting a plurality of feeds wherein said plurality of feeds comprises at least one feed (α) and at least another feed (β), wherein said feeds (α) and (β): (a) differ in Conradson Carbon Residue by at least about 2 wt % points or (b) differ in hydrogen content by at least about 0.2 wt %; or (c) differ in API gravities by at least about 2 points; or (d) differ in nitrogen content by at least about 50 ppm; or (e) differ in carbon-to-hydrogen ratio by at least about 0.3; or (f) differ in mean boiling point by at least about 200° F.; and wherein said spatially nonuniform injection is accomplished by (i) simultaneously injecting into a single reaction zone of a single riser said feed (α) from at least one injection nozzle of said riser and said feed (β) from the remaining nozzles of said riser;

(ii) simultaneously injecting said feed (α) into at least one of said reaction zones of said riser of said FCCU and said feed (β) into another of said reaction zones of said riser of said FCCU; or (iii) simultaneously injecting said feed (α) into at least one riser of said FCCU and said feed (β) into a second riser of said FCCU, wherein said feeds (α) and (β) are selected by generating a plot of conversion and a plot of coke make versus a feed quality index and selecting from the plots two feeds which exhibit an increase in liquid yield and a decrease in coke make equal to said predetermined increase and decrease as shown by D minus F and G minus E on FIGS. 1*a* and 1*b*, respectively.

3. The process of claim 2 wherein when at least one of said feeds (α) and (β) contains Conradson Carbon Residue, said feeds (α) and (β) differ in Conradson Carbon Residue by at least about 4 wt % points.

4. The process of claim 2 wherein when at least one of said feeds (α) and (β) contains Conradson Carbon Residue, said feeds (α) and (β) differ in API gravities by at least about 3 points.

5. The process of claim 2 wherein said feed (α) is injected via adjacent nozzles and said feed (β) is injected via adjacent nozzles.

6. The process of claim 2 wherein when at least one of said feeds (α) and (β) is a Conradson Carbon Residue containing feed, said feed is injected via at least one less nozzle than said feed differing in Conradson Carbon Residue by at least 2 wt % points.

7. The process of claim 2 wherein said plurality of feeds comprises two feeds.

8. The process of claim 2 wherein the greater the difference in quality of said feeds (α) and (β) as measured by (a), (b), (c), (d), (e) or (f), the greater the increase in liquid yield and decrease in coke make in said Fluid Catalytic Cracking process.

9. The process of claim 2 wherein said feeds (α) and (β) are injected according to step (i).

10. The process of claim 2 wherein when said feeds are injected according to step (i), said feeds (α) and (β) are injected at the same flow rates.

11. The process of claim 2 wherein when said feeds are injected according to step (i), said feeds (α) and (β) are injected at different flow rates.

* * * * *